United States Patent [19]

Schleifstein

[11] 4,111,647

[45] Sep. 5, 1978

[54] METHOD FOR MAKING FIRE RETARDANT ZIPPER

[75] Inventor: Robert Schleifstein, Freehold Township, Monmouth County, N.J.

[73] Assignee: Coats & Clark, Inc., Stamford, Conn.

[21] Appl. No.: 820,564

[22] Filed: Aug. 1, 1977

[51] Int. Cl.[2] ..... C09K 3/28; D06P 5/00

[52] U.S. Cl. ..... 8/4; 8/17; 8/171; 427/354; 427/390 D; 427/430 R

[58] Field of Search ..... 8/4, 17, 171; 427/390 D, 394, 430 R, 354

[56] References Cited

U.S. PATENT DOCUMENTS

| | | | |
|---|---|---|---|
| T916,008 | 11/1973 | Rothwell | 8/17 |
| T928,001 | 11/1974 | Blackwell | 8/17 |
| 1,837,150 | 12/1931 | Dreyfus | 252/8.1 |
| 2,334,000 | 11/1943 | Hamm | 8/4 |
| 2,662,834 | 12/1953 | Paist | 428/921 X |
| 3,236,676 | 2/1966 | Coates et al. | 428/921 X |
| 3,814,624 | 6/1974 | Scarborough | 252/8.1 |
| 3,939,547 | 2/1976 | Bernier et al. | 8/4 X |

OTHER PUBLICATIONS

Schmidlin, Preparation and Dyeing of Synthetic Fibres, pp. 106–109 (1963).

*Primary Examiner*—Harry J. Gwinnell
*Attorney, Agent, or Firm*—Burgess, Ryan and Wayne

[57] ABSTRACT

A method for making a fire retardant coil zipper is disclosed. The method involves using a fire retardant material bath exhaust process, that is, immersing the zipper in an aqueous bath of the fire retardant material and heating the bath under pressure to thereby impregnate the zipper with the fire retardant material while exhausting the bath.

13 Claims, No Drawings

METHOD FOR MAKING FIRE RETARDANT ZIPPER

BACKGROUND OF THE INVENTION

This invention relates generally to the manufacture of coil zippers and, specifically, this invention relates to a method of making coil zippers fire retardant.

Over the last few years, various governmental agencies have been requiring the treatment of certain fabric articles to make them fire retardant. These requirements have been especially stringent in manufacturing clothing and, in particular, clothing for children. Yet, the requirement for making certain articles fire retardant is not limited only to clothing but covers a wide variety of fabric materials. Furthermore, there are many fabric articles which are treated by their manufacturers to be fire retardant notwithstanding the fact that there might not be any particular requirement to do so. Thus, there are a wide variety of articles which are made fire retardant, either because of laws or regulations, or completely voluntarily. These articles include not only clothing, and in particular, children's clothing, but they also include camping equipment such as tents, sleeping bags, draperies and curtains, and the like. The treatment of the fabric used to make these articles is usually fairly straightforward.

But, many of these articles are fabricated from fabric and then have attached to them a variety of fasteners such as zippers.

Most people think of a zipper as being a metal fastener, but they are unaware that the latest development in zippers is the so-called coil zipper which is completely fabricated of a plastic material, usually a polyester. Furthermore, the zipper is combined with a fabric tape which, in turn, is attached to the garment or other article by stitching or some other suitable means.

It is not completely satisfactory to manufacture a garment, for instance, using a fire retardant fabric only to include a zipper which may not be fire retardant or which may be mounted on a fabric tape which is not fire retardant. Yet, the normal methods for impregnating a fabric with a fire retardant material are not completely satisfactory for rendering a coil zipper fire retardant.

SUMMARY OF THE INVENTION

It is, therefore, a primary object of the present invention to provide a method for making a coil zipper fire retardant.

It is another object of the present invention to provide a method for making a zipper fire retardant using currently available equipment.

It is still another object of the present invention to provide a method for making a zipper fire retardant easily and efficiently.

It is yet another object of the present invention to provide a method for making a zipper fire retardant in such a way that the fire retardant property will remain after repeated launderings.

Consistent with the foregoing objects, the present invention is a method for making coil zippers fire retardant by using an exhaust process to impregnate the zipper. More specifically, the zipper is immersed in a bath of the fire retardant material and heated under pressure to a temperature sufficient to cause the fire retardant material to impregnate the zipper while exhausting the bath, for a sufficient period of time to obtain this desired result.

DESCRIPTION OF THE PREFERRED EMBODIMENT

There is known in the industry a process known as the dye bath exhaust process or technique wherein a tape or finished chain is treated by package, beam, or skein dyeing techniques. Specifically, the dye bath exhaust technique involves preparing an aqueous bath of one or more color dyes and a dye carrier, all of which are well-known in the art and need not be further described herein, immersing a package, beam, or skein of the yarn to be dyed in the bath, and heating the bath under pressure to a sufficient temperature and for a sufficient time to cause the dye to be impregnated into the fiber and leave essentially just water remaining in the bath. In a package dyeing technique, yarn is wrapped on a tube over a spindle and the bath is pumped through the package from the inside-out and then reversed to move from the outside-in. The process is repeated until the desired effect is achieved. Of course, this process has been described somewhat generally, but the details thereof will be most apparent to one of ordinary skill in the art.

According to the instant invention, a similar technique is used to impregnate a coil zipper with a fire retardant material. Specifically, if a package treating technique is used, a package of the zipper tape or finished chain is made weighing, perhaps, five pounds per spool. A plurality of such packages are treated at one time in a vessel. The important consideration is that the temperature, pressure, pH, and treatment bath circulation be maintained.

Another important advantage of the instant process is that the zipper can be made fire retardant at the same time it is dyed, that is, the fire retardant material and the dye can both be included in the same bath, or the zipper can be made fire retardant in a separate process either before or after dyeing. In addition, other treatment materials may be included in the bath such as water repellants, mildewcides, softeners, lubricants, or mixtures thereof.

Zippers treated according to the instant invention will easily meet the flammability requirements of the Motor Vehicle Safety Standard No. 302. They will meet these requirements both before and after detergent laundering.

The inventive process can be used with any fire retardant material which can be made into an aqueous dispersion or emulsion. Typical of such fire retardant materials which are merely exemplary and should not be considered limiting are tris (2,3-dibromopropyl) phosphate, tris (2,3-dichloropropyl) phosphate, tris ($\beta$ chloropropyl) phosphate, and tris (beta (chloroethyl) phosphate. Additionally, mixtures of these materials, or other known fire retardant materials could be used.

As an aside, it should be noted that tris (2,3-dibromopropyl) phosphate has been found to be potentially carcinogenic, or to possibly have other harmful effects. For this reason, its use in fabrics directly contacting children's skin in an unlaundered condition is not recommended. Yet, its use in other environments wherein it is not in direct contact with the skin or wherein several launderings have taken place, may possibly be suggested. In any event, it is not the purpose of this invention to espouse the use of any particular fire retardant material. It should be clearly understood that any fire retardant material that is or may be banned or its use otherwise restricted by a competent government agency for a particular use should not be used contrary to law or regulation.

The amount of fire retardant material used can vary within a wide range and is generally used in an amount of from about 1 to about 20 percent owg. The terminology "owg" is commonly used in the art as meaning "on the weight of the goods," that is, the percent of dry material by weight based on the weight of the goods to be treated. Furthermore, this percentage is the amount of fire retardant material actually delivered on the goods, the initial bath containing somewhat more, but in an amount easily determined by one skilled in the art. The preferred range is from about 2 to about 12 percent owg.

More specifically, the preferred fire retardant material is tris (2,3-dichloropropyl) phosphate in an amount of from about 2 to about 20 percent owg, with the more preferred amount being from about 4 to about 12 percent owg. If tris (2,3-dibromopropyl) phosphate is used, about half the amount is used, that is, from about 1 to about 10 percent owg generally and from about 2 to about 6 percent owg being preferred.

As for the process conditions, the zippers are treated under conditions of raised temperature and pressure as long as the temperature is below the stabilization temperature of the particular zipper chain. In general, a temperature range of from about 220° to about 300° F with the corresponding pressure in a closed vessel is used for a period of at least about 15 minutes and suitably to about 60 minutes or even longer. It has generally been found that the fire retardant material used does not materially affect the temperature-pressure relationship of the water bath. Thus, in general, standard temperature-pressure tables of water will show the corresponding pressure. The preferred temperature range is from about 250° to about 275° F.

The practice of the instant invention will be better understood by reference to the following example which is not to be considered in any way limiting:

EXAMPLE

In making a white zipper chain fire retardant, the package was first bleached and scoured. It should be noted that this is not necessary if the chain is to be dyed. In this particular case the package was dry so it was wet out in a water bath in the package machine by running for about ten minutes at about 180° F. If the package is already wet, this step may be omitted.

To a fresh water bath at about 160° F, 30 percent owg of a 60 percent tris (2,3-dichloropropyl) phosphate emulsion was added along with 1 percent owg of a dye carrier. The bath was heated to 180° F. The package was in place in the machine and the bath was run for 10 minutes at this temperature. The pH was adjusted to about 5.5 with a 10 percent acetic acid solution. The pH could be from about 5.0 to about 5.5. The temperature was then rapidly raised to 270° F and maintained at that temperature for 1 hour. It should be noted that since this is a closed system, the pressure was also correspondingly raised. The temperature was dropped to 180° F and the bath was drained. The package was washed in running water at 120° F for 10 minutes. To a fresh bath at 120° F was added 0.5 percent owg of Triton X-100 and 0.5 percent owg trisodium phosphate. The package was treated for 15 minutes with this bath and then washed for 10 minutes with water at 120° F. Following this wash, there was a 5 minute cold running water wash. The package was then removed from the machine and oven-dried.

It should be noted that dye carriers are well-known in the art and include such materials as butyl benzoate, various chlorinated benzenes, methyl salicylate, and the like. The Triton X-100 used to wash the package is polyethylene glycol p-isooctylphenyl ether which is a common non-ionic detergent. Any non-ionic detergent can be used.

The zipper used was a 100 percent polyester chain. The treated zipper was then tested using Motor Vehicle Safety Standard No. 302 — Horizontal Flammability Test — 15 second ignition. The results are as shown in Table I.

TABLE I

| Sample No. | % FR** (Nominal) | Laundered | Burn Dist. "D" (in.) | After Flame Time "T" (sec.) | Burn Rate (in./min.) $B = \frac{60 \times D}{T}$ | Test Criterion |
|---|---|---|---|---|---|---|
| 1 | None | No | 11.0 | 118 | 5.6 | Fail |
| 2 | 6.0 | No | 3.25 | 93.8 | 2.1 | Pass |
| 3 | 9.0 | No | 1.13 | 15.3 | —* | Pass |
| 4 | 12.0 | No | 0 | 0 | —* | Pass |
| 5 | 6.0 | Yes | 2.75 | 81.8 | 2.0 | Pass |
| 6 | 9.0 | Yes | 1.1 | 39.6 | —* | Pass |
| 7 | 12.0 | Yes | 1.3 | 12.4 | —* | Pass |

Burn Rate must be <4.0 inches/minute
*When Burn Distance <2.0 inches, sample automatically passes.
**tris dichloropropyl phosphate Flammability of the zipper sewn in a fire retardant cotton tent fabric was also tested. The fabric was 11.6 oz./yd.$^2$ fire retardant cotton canvas. The zipper was #6 100 percent polyester coil. The Motor Vehicle Safety Standard No. 302 was used as in the previous test. The results are shown in Table II.

TABLE II

| Sample | % FR** Zipper (Nominal) | Distance "D" (in.) | After Flame Time "T" (sec.) | Burn Rate (in./min.) $B = \frac{60 \times D}{T}$ | Test Criterion |
|---|---|---|---|---|---|
| Fabric Only | — | 11.0 | 201.8 | 3.27 | Pass |
| 1 | None | 11.0 | 155.6 | 3.99 | Pass |
| 2 | 6.0 | 11.0 | 148.5 | 4.44 | Pass |
| 3 | 9.0 | 11.0 | 175.1 | 3.77 | Pass |
| 4 | 12.0 | 11.0 | 324.4 | 2.03 | Pass |

**tris dichloropropyl phosphate

I claim:

1. A method of making a fire retardant coil zipper comprising the steps of:

(A) preparing a bath of an aqueous dispersion or emulsion consisting essentially of a sufficient amount of a fire retardant material and a dye carrier to substantially completely impregnate said coil zipper while said bath becomes substantially completely exhausted of said material;

(B) immersing said coil zipper in said bath in a closed vessel;

(C) adjusting the pH of said bath to from about 5.0 to about 5.5;

(D) heating said bath to a temperature of about 220° to about 300° F;

(E) circulating said bath through said coil zipper while maintaining the temperature of said bath at said temperature for at least about 15 minutes whereby said fire retardant material substantially completely impregnates said coil zipper while said bath becomes substantially completely exhausted of said material;

(F) cooling said bath to below about 212° F; and (G) removing said coil zipper.

2. A method as claimed in claim 1, wherein said fire retardant material is selected from the group consisting of tris (2,3-dibromopropyl) phosphate, tris (2,3-dichloropropyl) phosphate, tris (beta chloro) phosphate, and tris (beta chloroethyl) phosphate.

3. A method as claimed in claim 1, wherein from about 1 to about 20 percent owg of said fire retardant material is used.

4. A method as claimed in claim 3, wherein said fire retardant material is tris (2,3-dichloropropyl) phosphate and it is used in an amount of from about 2 to about 20 percent owg.

5. A method as claimed in claim 4, wherein said material is used in an amount of from about 4 to about 12 percent owg.

6. A method as claimed in claim 3, wherein said fire retardant material is tris (2,3-dibromopropyl) phosphate and it is used in an amount of from about 1 to about 10 percent owg.

7. A method as claimed in claim 6, wherein said material is used in an amount of from about 2 to about 6 percent owg.

8. A method as claimed in claim 1, wherein said temperature is from about 250° to about 275° F.

9. A method as claimed in claim 8, wherein said bath is maintained at said temperature for from about 30 to about 60 minutes.

10. A method as claimed in claim 1, further comprising heating said bath to about 180° F and holding the same at this temperature prior to step B).

11. A method as claimed in claim 10, further comprising cooling said bath to about 180° F in step F), rinsing said zipper in a solution of a non-ionic detergent and trisodium phosphate, washing said zipper, and drying said zipper.

12. A method as claimed in claim 11, wherein said detergent is polyethylene glycol p-isooctylphenyl ether.

13. A method as claimed in claim 1, wherein said bath further includes a dye, water repellant, mildewcide, softener, lubricant, or mixtures thereof.

* * * * *